US012172263B2

(12) United States Patent
Yen et al.

(10) Patent No.: US 12,172,263 B2
(45) Date of Patent: Dec. 24, 2024

(54) CHEMICAL MECHANICAL PLANARIZATION TOOL

(71) Applicant: Taiwan Semiconductor Manufacturing Co., Ltd., Hsinchu (TW)

(72) Inventors: Michael Yen, Hsinchu (TW); Kao-Feng Liao, Hsinchu (TW); Hsin-Ying Ho, Kaohsiung (TW); Chun-Wen Hsiao, Hsinchu (TW); Sheng-Chao Chuang, Hsinchu (TW); Ting-Hsun Chang, Kaohsiung (TW); Fu-Ming Huang, Shengang Township (TW); Chun-Chieh Lin, Hsinchu (TW); Peng-Chung Jangjian, Zhudong Township (TW); Ji James Cui, Hsinchu (TW); Liang-Guang Chen, Hsinchu (TW); Chih Hung Chen, Hsinchu (TW); Kei-Wei Chen, Tainan (TW)

(73) Assignee: TAIWAN SEMICONDUCTOR MANUFACTURING COMPANY, LTD., Hsinchu (TW)

( * ) Notice: Subject to any disclaimer, the term of this patent is extended or adjusted under 35 U.S.C. 154(b) by 0 days.

(21) Appl. No.: 18/312,753

(22) Filed: May 5, 2023

(65) Prior Publication Data

US 2023/0271298 A1 Aug. 31, 2023

Related U.S. Application Data

(63) Continuation of application No. 16/550,021, filed on Aug. 23, 2019, now Pat. No. 11,679,469.

(51) Int. Cl.

| | |
|---|---|
| ***B24B 37/26*** | (2012.01) |
| ***B24B 37/005*** | (2012.01) |
| ***B24B 37/04*** | (2012.01) |
| ***B24B 37/24*** | (2012.01) |

(52) U.S. Cl.

CPC ..... *B24B 37/26* (2013.01); *B24B 37/005* (2013.01); *B24B 37/042* (2013.01); *B24B 37/24* (2013.01)

(58) Field of Classification Search

CPC ..... B24D 7/14; B24B 37/16; B24B 37/66; B24B 37/26; B24B 37/245; B24B 37/24; B24B 37/22

See application file for complete search history.

(56) References Cited

U.S. PATENT DOCUMENTS

| | | | | |
|---|---|---|---|---|
| 5,177,908 A | | 1/1993 | Tuttle | |
| 5,984,769 A | | 11/1999 | Bennett et al. | |
| 6,062,958 A | | 5/2000 | Wright et al. | |
| 6,102,776 A | * | 8/2000 | Boggs | B24B 49/10 451/8 |

(Continued)

*Primary Examiner* — Joel D Crandall
(74) *Attorney, Agent, or Firm* — Slater Matsil, LLP

(57) ABSTRACT

A chemical mechanical planarization (CMP) tool includes a platen and a polishing pad attached to the platen, where a first surface of the polishing pad facing away from the platen includes a first polishing zone and a second polishing zone, where the first polishing zone is a circular region at a center of the first surface of the polishing pad, and the second polishing zone is an annular region around the first polishing zone, where the first polishing zone and the second polishing zone have different surface properties.

20 Claims, 9 Drawing Sheets

(56) References Cited

U.S. PATENT DOCUMENTS

| | | | | |
|---|---|---|---|---|
| 6,135,863 | A | 10/2000 | Zhang et al. | |
| 6,152,806 | A * | 11/2000 | Nystrom | B24B 37/042 451/529 |
| 6,663,472 | B2 * | 12/2003 | Lim | B24B 37/26 451/41 |
| 6,863,771 | B2 * | 3/2005 | Brown | B24B 1/005 451/41 |
| 8,715,035 | B2 | 5/2014 | Roy et al. | |
| 2003/0045208 | A1 * | 3/2003 | Neidrich | B24B 37/26 451/41 |
| 2005/0211376 | A1 | 9/2005 | Prasad | |
| 2005/0272348 | A1 * | 12/2005 | Min | B24B 37/20 451/11 |
| 2011/0237161 | A1 * | 9/2011 | Kiesel | B24B 37/04 451/364 |
| 2017/0355059 | A1 * | 12/2017 | Benner | H01L 21/6708 |
| 2018/0304434 | A1 | 10/2018 | Sakugawa et al. | |

* cited by examiner

CHEMICAL MECHANICAL PLANARIZATION TOOL

PRIORITY CLAIM AND CROSS-REFERENCE

This application is a continuation of U.S. patent application Ser. No. 16/550,021, entitled "Chemical Mechanical Planarization Tool," filed on Aug. 23, 2019, which application is incorporated herein by reference.

BACKGROUND

Generally, semiconductor devices comprise active components, such as transistors, formed on a substrate. Any number of interconnect layers may be formed over the substrate connecting the active components to each other and to outside devices. The interconnect layers are typically made of low-k dielectric materials and metallic trenches/vias.

As the layers of a device are formed, planarization processes may be performed to planarize the layers to facilitate formation of subsequent layers. For example, the formation of metallic features in the substrate or in a metal layer may cause uneven topography. This uneven topography may create difficulties in the formation of subsequent layers. For example, uneven topography may interfere with the photolithographic process commonly used to form various features in a device. Therefore, it may be advantageous to planarize the surface of the device after various features or layers are formed.

Chemical Mechanical Polishing (CMP) is a common practice in the formation of integrated circuits. Typically, CMP is used for the planarization of semiconductor wafers. CMP takes advantage of the synergetic effect of both physical and chemical forces for the polishing of wafers. It is performed by applying a load force to the back of a wafer while the wafer rests on a polishing pad. A polishing pad is placed against the wafer. Both the polishing pad and the wafer are then rotated while a slurry containing both abrasives and reactive chemicals is passed therebetween. CMP is an effective way to achieve global planarization of wafers.

BRIEF DESCRIPTION OF THE DRAWINGS

Aspects of the present disclosure are best understood from the following detailed description when read with the accompanying figures. It is noted that, in accordance with the standard practice in the industry, various features are not drawn to scale. In fact, the dimensions of the various features may be arbitrarily increased or reduced for clarity of discussion.

DETAILED DESCRIPTION

Figure 1:
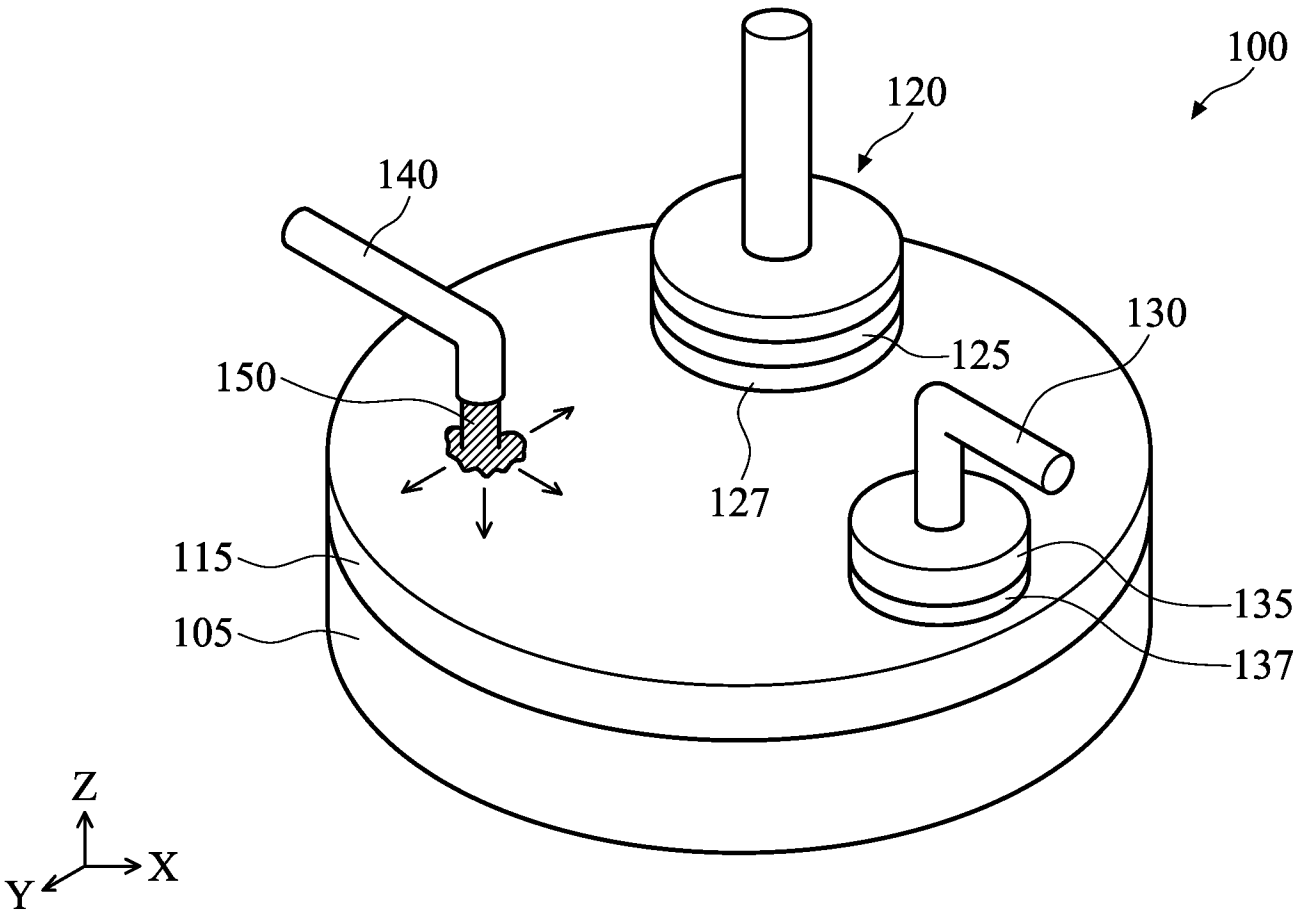
FIG. 1 illustrates a perspective view of a chemical mechanical planarization apparatus, in accordance with an embodiment.

The following disclosure provides many different embodiments, or examples, for implementing different features of the invention. Specific examples of components and arrangements are described below to simplify the present disclosure. These are, of course, merely examples and are not intended to be limiting. For example, the formation of a first feature over or on a second feature in the description that follows may include embodiments in which the first and second features are formed in direct contact, and may also include embodiments in which additional features may be formed between the first and second features, such that the first and second features may not be in direct contact. Through the description herein, unless other specified, the same reference numeral in different figures refers to the same or similar component.

Further, spatially relative terms, such as "beneath," "below," "lower," "above," "upper" and the like, may be used herein for ease of description to describe one element or feature's relationship to another element(s) or feature(s) as illustrated in the figures. The spatially relative terms are intended to encompass different orientations of the device in use or operation in addition to the orientation depicted in the figures. The apparatus may be otherwise oriented (rotated 90 degrees or at other orientations) and the spatially relative descriptors used herein may likewise be interpreted accordingly.

Various representative embodiments are described with respect to a CMP tool, and in particular, various designs for the polishing pad of a CMP tool and methods of using the CMP tool with the polishing pad. In some embodiments, an upper surface of a polishing pad has a plurality of concentric polishing zones, which includes a circular shaped center polishing zone and one or more annular shaped polishing zones around the center polishing zone. Each of polishing zones may have a different surface property to provide different polishing characteristics for the CMP process. For example, each of the polishing zones may be formed using a different material (e.g., an organic material, an inorganic material, or a mixture of organic material and inorganic material), and/or may have a different groove pattern. During the CMP process, based on real-time measurements of the surface conditions of the wafer, a controller of the CMP tool may move the carrier from a first location over the polishing pad to a second location over the polishing pad to improve the planarity of the polished wafer surface.

Chemical mechanical planarization (CMP) is a method of planarizing features produced in the manufacture of semiconductor devices. The process uses an abrasive material in a reactive chemical slurry in conjunction with a polishing pad. The polishing pad typically has a greater diameter than that of the semiconductor wafer. The pad and wafer are pressed together during the CMP process. The process removes material and tends to even out irregular topography, making the wafer flat or substantially planar. This prepares the wafer for the formation of additional overlying circuit elements. For example, chemical mechanical planarization can bring an entire wafer surface within a given depth of field of a photolithography system. Typical depth-of-field specifications are on the order of, e.g., angstroms. In some implementations, chemical mechanical planarization may also be employed to selectively remove material based on its location on the wafer.

In a CMP process, a wafer is placed in a carrier head (also referred to as a carrier), where the wafer is held in place by a retaining ring. The carrier head and the wafer are then rotated as downward pressure is applied to the wafer to press against the polishing pad. A reactive chemical solution is dispensed on a contacting surface of the polishing pad to aid planarization. The surface of a wafer may thus be planarized using a combination of both mechanical and chemical mechanisms.

FIG. 1 illustrates a perspective view of a chemical mechanical planarization apparatus 100 in accordance with some embodiments. The chemical mechanical planarization apparatus 100 includes a platen 105 and a polishing pad 115 over (e.g., glued to) the platen 105. In some embodiments, the polishing pad 115 includes a single layer or a composite layer of materials, such as felts, polymer impregnated felts, microporous polymer films, microporous synthetic leathers, filled polymer films, unfilled textured polymer films, combinations thereof, or the like. Representative polymers include polyurethane, polyolefins, or the like.

As illustrated in FIG. 1, a polisher head 120 is placed over the polishing pad 115. The polisher head 120 includes a carrier 125 and a retainer ring 127. The retainer ring 127 is mounted to the carrier 125 using mechanical fasteners (e.g., screws, or the like) or other suitable attachment means. During a representative chemical mechanical planarization process, a workpiece (e.g., a semiconductor wafer; not shown in FIG. 1 but illustrated and described below with respect to FIG. 3) is placed within the carrier 125 and is held by the retainer ring 127. In some embodiments, the retainer ring 127 has a substantially annular shape with a substantially hollow center. The workpiece is placed in the center of the retainer ring 127 such that the retainer ring 127 holds the workpiece in place during a chemical mechanical planarization process. The workpiece is positioned such that a surface to be polished faces in a direction (for example, downward) towards the polishing pad 115. The carrier 125 is configured to apply downward force or pressure urging the workpiece into contact with the polishing pad 115. The polisher head 120 is configured to rotate the workpiece over the polishing pad 115 during the chemical mechanical planarization process, thereby imparting mechanical abrading action to affect planarization or polishing of a contacting surface of the workpiece.

In some embodiments, the chemical mechanical planarization apparatus 100 includes a slurry dispenser 140 configured to deposit a slurry 150 onto the polishing pad 115. The platen 105 is configured to rotate, causing the slurry 150 to be distributed between the workpiece and the platen 105 through a plurality of grooves in the retainer ring 127. The plurality of grooves may extend from an outer sidewall of the retainer ring 127 to an inner sidewall of the retainer ring 127.

The composition of the slurry 150 may depend on which types of material are to be polished or removed. For example, the slurry 150 may comprise a reactant, an abrasive, a surfactant, and a solvent. The reactant may be a chemical, such as an oxidizer or a hydrolyzer, which chemically reacts with a material of the workpiece in order to assist the polishing pad 115 in abrading or removing material. In some embodiments in which the material to be removed includes, e.g., tungsten, the reactant may be, e.g., hydrogen peroxide, $Cr_2O_7$, $MnO_4$, $OsO_4$; although other suitable reactants, such as hydroxylamine, periodic acid, other periodates, iodates, ammonium persulfate, peroxomonosulfates, peroxymonosulfuric acid, perborates, malonamide, combinations of same, or the like, that are configured to aid removal of material may be alternatively, conjunctively, or sequentially employed. In other embodiments, other reactants may be used to remove other types of materials. For example, in embodiments in which a material to be removed includes, e.g., an oxide, the reactant may comprise, e.g., nitric acid ($HNO_3$), potassium hydroxide (KOH), ammonium hydroxide ($NH_4OH$), combinations thereof, or the like.

The abrasive may include any suitable particulate that, in conjunction with the relative mechanical movement of the polishing pad 115, is configured to polish or planarize the workpiece. In some embodiments, the abrasive includes colloidal aluminum oxide. In some embodiments, the abrasive includes silicon oxide, aluminum oxide, cerium oxide, polycrystalline diamond, polymer particles (e.g., polymethacrylate, or the like), combinations thereof, or the like.

The surfactant may be utilized to help disperse the reactant(s) and abrasive(s) within the slurry 150, and to prevent (or otherwise reduce the occurrence of) agglomeration of the abrasive during the chemical mechanical planarization process. In some embodiments, the surfactant may include polyethylene glycol (PEG), polyacrylic acid, sodium salts of polyacrylic acid, potassium oleate, sulfosuccinates, sulfosuccinate derivatives, sulfonated amines, sulfonated amides, sulfates of alcohols, alkylanyl sulfonates, carboxylated alcohols, alkylamino propionic acids, alkyliminodipropionic acids, potassium oleate, sulfosuccinates, sulfosuccinate derivatives, sulfates of alcohols, alkylanyl sulfonates, carboxylated alcohols, sulfonated amines, sulfonated amides, alkylamino propionic acids, alkyliminodipropionic acids, combinations thereof, or the like. However, such representative embodiments are not intended to be limited to the recited surfactants. Those skilled in the art will appreciate that any suitable surfactant may be alternatively, conjunctively, or sequentially employed.

In some embodiments, the slurry 150 includes a solvent that may be utilized to combine the reactant(s), the abrasive(s), and the surfactant(s), and allow the mixture to be moved and dispersed onto the polishing pad 115. In some embodiments, the solvent includes, e.g., deionized water (DIW), alcohol, or an azeotropic mixture thereof; however, other suitable solvent(s) may be alternatively, conjunctively, or sequentially employed.

Additionally, if desired, other additives may also be added in order to help control or otherwise benefit the CMP process. For example, a corrosion inhibitor may be added in order to help control the corrosion. In one particular embodiment the corrosion inhibitor may be an amino acid such as glycine. However, any suitable corrosion inhibitor may be utilized.

In another embodiment, a chelating agent(s) is added to the slurry 150. The chelating agent may be an agent such as ethylenediaminetetraacetic acid (EDTA), $C_6H_8O_7$, $C_2H_2O_4$, combinations thereof, or the like. However, any suitable chelating agent may be utilized.

In yet another embodiment, the slurry 150 includes a pH adjuster(s) in order to control the pH value of the slurry 150. For example, a pH adjuster such as HCl, $HNO_3$, $H_3PO_4$, $C_2H_2(COOH)_2$, KOH, $NH_4OH$, combinations thereof, or the like, may be added to the slurry 150 in order to adjust the pH value of the slurry 150 up or down.

Additionally, other additives may also be added to help control and manage the CMP process. For example, downforce enhancers (e.g., an organic compound), polish rate inhibitors, or the like may also be added. Any suitable additives which may be useful to the polishing process may be utilized, and all such additives are fully intended to be included within the scope of the embodiments.

In some embodiments, the chemical mechanical planarization apparatus 100 includes a pad conditioner 137 attached to a pad conditioner head 135. The pad conditioner head 135 is configured to rotate the pad conditioner 137 over the polishing pad 115. The pad conditioner 137 is mounted to the pad conditioner head 135 using mechanical fasteners (e.g., screws, or the like) or by other suitable attachment means. A pad conditioner arm 130 is attached to the pad conditioner head 135, and is configured to move the pad conditioner head 135 and the pad conditioner 137 in a sweeping motion across a region of the polishing pad 115. In some embodiments, the pad conditioner head 135 is mounted to the pad conditioner arm 130 using mechanical fasteners (e.g., screws, or the like) or by other suitable attachment means. The pad conditioner 137 comprises a substrate over which an array of abrasive particles is bonded. The pad conditioner 137 removes built-up wafer debris and excess slurry 150 from the polishing pad 115 during the CMP processing. In some embodiments, the pad conditioner 137 also acts as an abrasive for the polishing pad 115 to renew, or create a desired texture (such as, e.g., grooves, or the like) against which the workpiece may be polished.

As illustrated in FIG. 1, the chemical mechanical planarization apparatus 100 has a single polisher head (e.g., 120) and a single polishing pad (e.g., 115). However, in other embodiments, the chemical mechanical planarization apparatus 100 may have multiple polisher heads or multiple polishing pads. In some embodiments in which the chemical mechanical planarization apparatus 100 has multiple polisher heads and a single polishing pad, multiple workpieces (e.g., semiconductor wafers) may be polished at a same time. In other embodiments in which the chemical mechanical planarization apparatus 100 has a single polisher head and multiple polishing pads, a chemical mechanical planarization process may include a multi-step process. In such embodiments, a first polishing pad may be used for bulk material removal from a wafer, a second polishing pad may be used for global planarization of the wafer, and a third polishing pad may be used, e.g., to buff a surface of the wafer. In some embodiments, different slurry compositions may be used for different stages of chemical mechanical planarization processing. In still other embodiments, a same slurry composition may be used for all chemical mechanical planarization stages.

Figure 2:
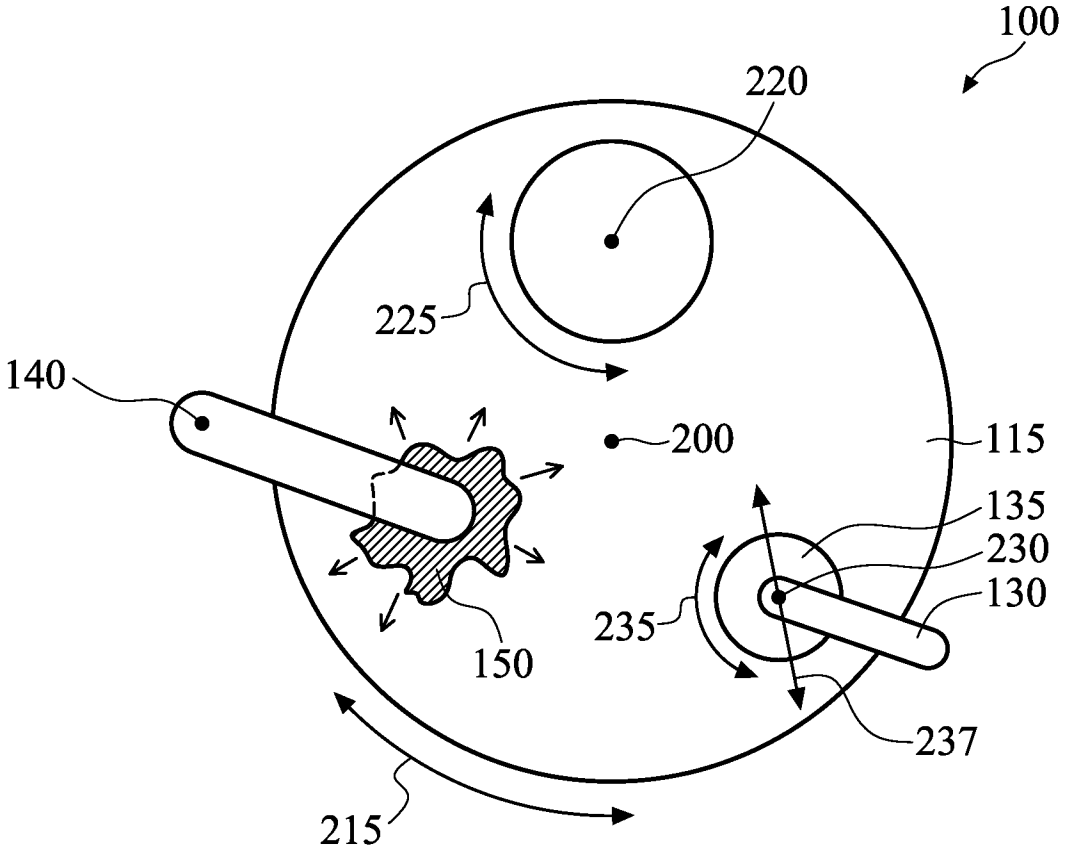
FIG. 2 illustrates a top view of the chemical mechanical planarization apparatus of FIG. 1, in accordance with an embodiment.

FIG. 2 illustrates a top view (or plan view) of the chemical mechanical planarization apparatus 100 of FIG. 1, in accordance with some embodiments. The platen 105 (located beneath the polishing pad 115 in FIG. 2) is configured to rotate in a clockwise or a counter-clockwise direction, indicated by a double-headed arrow 215 around an axis extending through a centrally-disposed point 200, which is a center point of the platen 105. The polisher head 120 is configured to rotate in a clockwise or a counter-clockwise direction, indicated by a double-headed arrow 225 around an axis extending through a point 220, which is a center point of the polisher head 120. The axis through the point 200 is parallel to the axis through the point 220. In the illustrated embodiment, the axis through the point 200 is spaced apart from the axis through the point 220. The pad conditioner head 135 is configured to rotate in a clockwise or a counter-clockwise direction, indicated by a double-headed arrow 235 around an axis extending through a point 230, which is a center point of the pad conditioner head 135. The axis through the point 200 is parallel to the axis through the point 230. The pad conditioner arm 130 is configured to move the pad conditioner head 135 in an effective arc during rotation of the platen 105, as indicated by a double-headed arrow 237.

Figure 3:
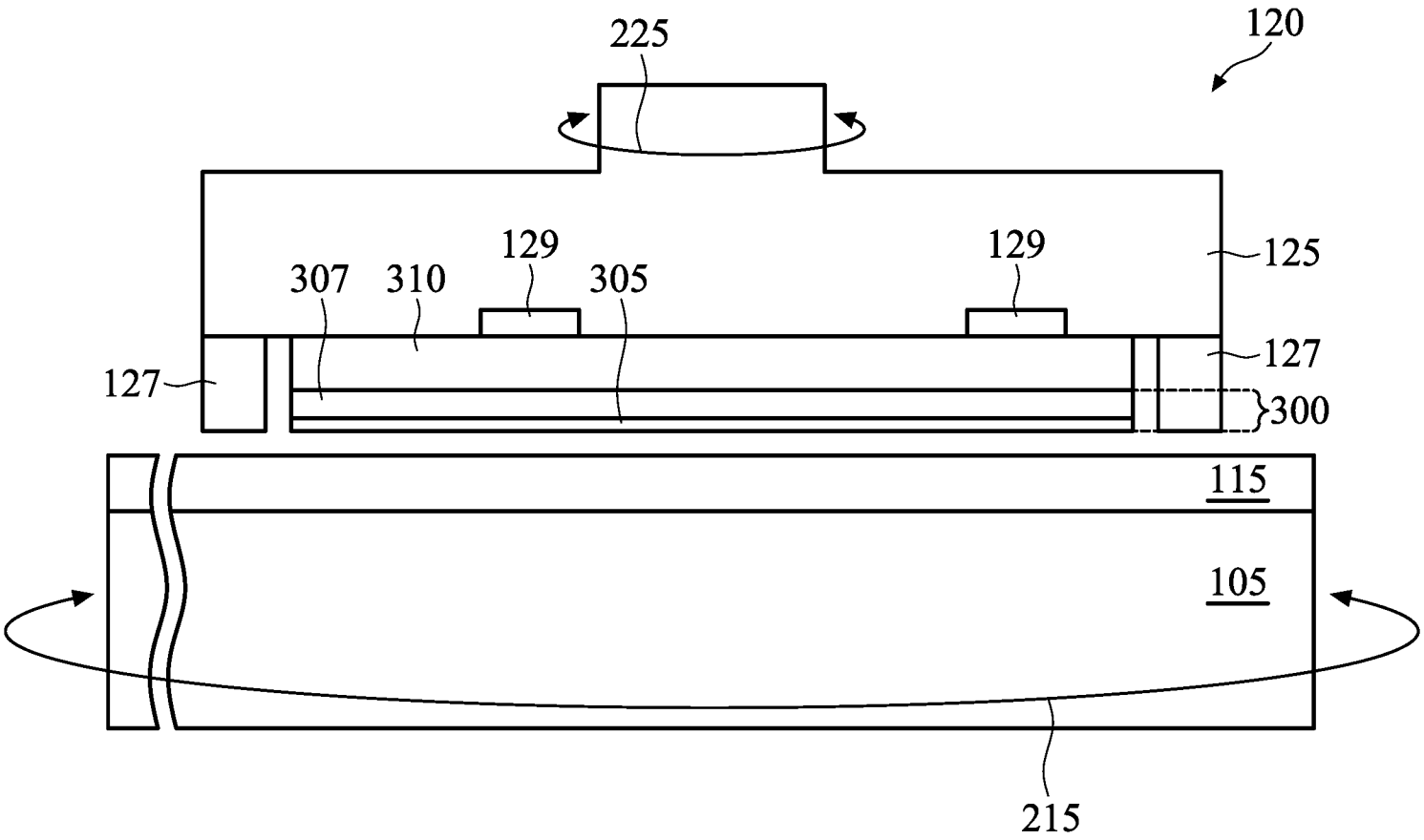
FIG. 3 illustrates a cross-sectional view of a polisher head, in accordance with an embodiment.

FIG. 3 illustrates a cross-sectional view of the polisher head 120, in accordance with some embodiments. The carrier 125 includes a membrane 310 configured to interface with a wafer 300 during the CMP process. In some embodiments, the chemical mechanical planarization apparatus 100 includes a vacuum system coupled to the polisher head 120, and the membrane 310 is configured to pick up and hold the wafer 300 onto the membrane 310 using, e.g., vacuum suction.

In some embodiments, the wafer 300 is a semiconductor wafer comprising, for example, a semiconductor substrate (e.g., comprising silicon, a III-V semiconductor material, or the like), active devices (e.g., transistors, or the like) formed in or on the semiconductor substrate, and various interconnect structures. Representative interconnect structures may include conductive features, which electrically connect the active devices to form functional circuits. In various embodiments, the CMP process may be applied to the wafer 300 during any stage of manufacture in order to planarize features or otherwise remove material (e.g., dielectric material, semiconductor material, conductive material, or the like) of the wafer 300. The wafer 300 may include any subset of the above-identified features, as well as other features.

In the example of FIG. 3, the wafer 300 comprises bottommost layer(s) 305 and overlying layer(s) 307. The bottommost layer 305 is subjected to polishing/planarization during a CMP process. In some embodiments in which the bottommost layer 305 comprises tungsten, the bottommost layer 305 may be polished to form, e.g., contact plugs contacting various active devices of the wafer 300. In embodiments in which the bottommost layer 305 comprises copper, the bottommost layer 305 may be polished to form, e.g., various interconnect structures of the wafer 300. In embodiments in which the bottommost layer 305 comprises a dielectric material, the bottommost layer 305 may be polished to form, e.g., shallow trench isolation (STI) structures on the wafer 300.

In some embodiments, the bottommost layer 305 may have a non-uniform thickness (e.g., exhibiting local or global topological variation of an exposed surface of the bottommost layer 305) resulting from process variations experienced during deposition of the bottommost layer 305. For example, in an embodiment in which the bottommost layer 305 being planarized comprises tungsten, the bottommost layer 305 may be formed by depositing tungsten into an opening through a dielectric layer using a chemical vapor deposition (CVD) process. Due to CVD process variations or other underlying structures, the bottommost layer 305 may have a non-uniform thickness.

In some embodiments, a thickness profile of the bottommost layer 305 may be measured using ellipsometry, interferometry, reflectometry, picosecond ultrasonics, atomic force microscopy (AFM), scanning tunneling microscopy (STM), scanning electron microscopy (SEM), transmission electron microscopy (TEM), or the like. In some embodiments, a thickness measurement apparatus (not shown) may be external to the chemical mechanical planarization apparatus 100, and a thickness profile of the bottommost layer 305 may be measured or otherwise determined before loading the wafer 300 into the chemical mechanical planarization apparatus 100. In other embodiments, a thickness measurement apparatus may be a part of the chemical mechanical planarization apparatus 100, and a thickness profile of the bottommost layer 305 may be measured or otherwise determined after loading the wafer 300 into the chemical mechanical planarization apparatus 100.

After measurement, the bottommost layer 305 may be planarized by the chemical mechanical planarization apparatus 100. In a particular embodiment the polisher head 120 may be lowered such that the bottommost layer 305 of the wafer 300 is in physical contact with the polishing pad 115. Additionally, the slurry 150 is also introduced onto the polishing pad 115, such that the slurry 150 will come into contact with the exposed surfaces of the bottommost layer 305. The surface (e.g., the bottommost layer 305) of the wafer 300 may thus be planarized using a combination of both mechanical and chemical forces.

FIG. 3 further illustrates a plurality of sensors 129 in the carrier 125. The sensors 129 may be attached to the lower surface of the carrier 125 (or upper surface of the membrane 310), as illustrated in FIG. 3. The sensors 129 may alternatively be attached to the lower surface of the membrane 310 or other suitable locations. The sensors 129 are used for measuring the loads (also referred to as the load forces) exerted in different regions of the wafer 300 in real time during the CMP process, in some embodiments. For example, the surface of the wafer 300 may be divided into five to seven different regions, and each region is measured by a corresponding sensor 129 to monitor (e.g., measure) the load of the region. The measurements from the sensors 129 may be used to improve the uniformity (e.g., evenness) of the wafer surface and to improve the life span of the polishing pad, details of which are discussed hereinafter.

The pattern density on the surface of the wafer may vary in different regions, e.g., due to the design of the integrated circuits on the wafer. The different pattern densities in different regions of the wafer may cause a loading effect during the CMP process. For example, regions of the wafer surface with high pattern densities may have a slower removal rate (e.g., also referred to as etch rate) during the CMP process than regions with low pattern densities, which may cause unevenness across the wafer surface. An uneven wafer surface may cause variation in the load forces in different regions of the wafer, and may cause uneven distribution of the slurry across the wafer surface. Uneven distribution of the slurry may in turn exacerbate the unevenness of the wafer surface. Conventional polishing pad may have a homogeneous surface, e.g., the polishing pad surface may be formed of a same material and have a same groove pattern, and therefore, may not be able to address the above described issues effectively.

The current disclosure discloses various embodiment polishing pads (e.g., 115A, 115B, 115C) having a non-homogenous surface with multiple polishing zones, where each polishing zone is formed of a different material and/or has a different groove pattern. Therefore, each polishing zone of the polishing pad has a different surface property (e.g., hardness, roughness, friction coefficient, or the like), which results in a different polishing characteristics (e.g., different load, different friction coefficient, or different etch rate) in each polishing zone. Recall that the carrier 125 (see FIG. 3) has sensors 129 for monitoring the loads in different regions of the wafer. The measurements of the sensors 129 may be used by a controller (e.g., a processor) of the CMP tool to determine the location of the wafer over the polishing pad 115 (e.g., 115A, 115B, 115C), such that different regions of the wafer are polished differently (e.g., by different polishing zones of the polishing pad) to compensate for the loading effect of the wafer, thereby improving the evenness of the polished wafer. Details are discussed hereinafter.

Figure 4B:
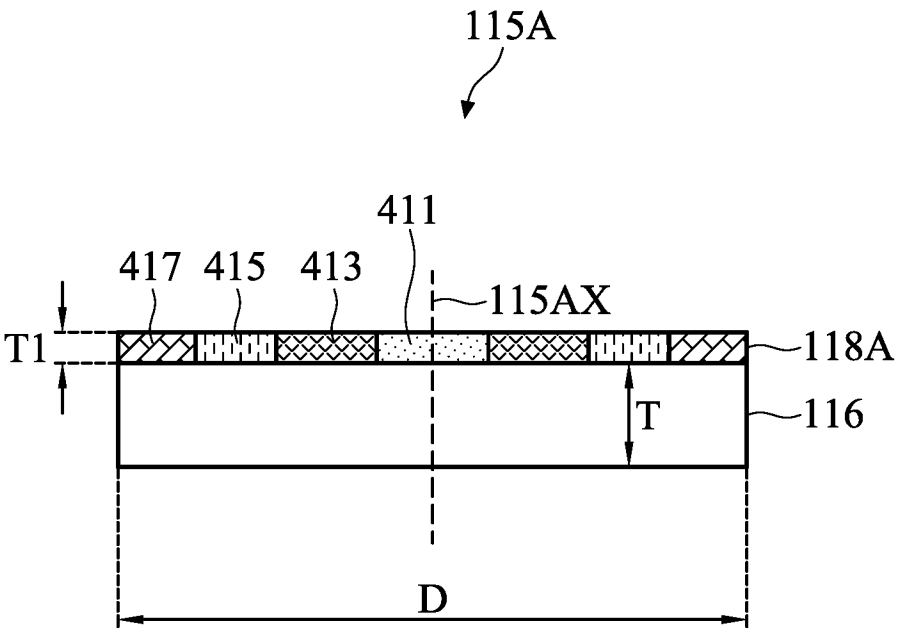
FIGS. 4A and 4B illustrate a top view and a cross-sectional view, respectively, of a polishing pad, in accordance with an embodiment.
Figure 4A:
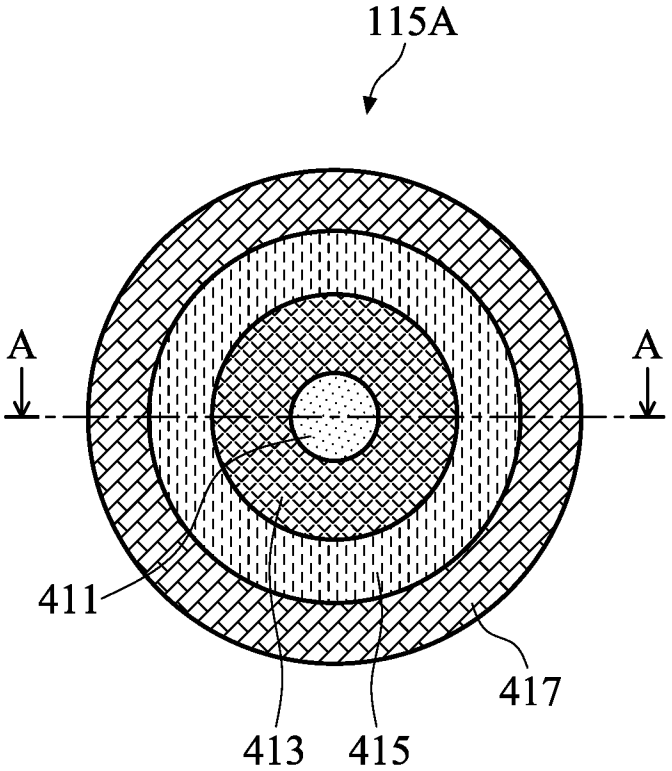

FIGS. 4A and 4B illustrate a top view and a cross-sectional view, respectively, of a polishing pad 115A, in accordance with an embodiment. FIG. 4B is the cross-sectional view of FIG. 4A along cross-section A-A. The polishing pad 115A may be used as the polishing pad 115 in FIGS. 1-3.

In some embodiments, a diameter D of the polishing pad is between about 10 inches and about 50 inches. As illustrated in FIG. 4B, the polishing pad 115A has a base layer 116 and a top layer 118A formed over the base layer 116. The base layer 116 may be formed of a bulk material (e.g., plastics) to provide structural support and achieve a target level of rigidity. Example materials for the base layer 116 include epoxy resin, polyurethane, polyester resin, and polyimides. In some embodiments, after the base layer 116 (e.g., a pad formed of a bulk plastic material) is formed, the surface of the base layer 116 may not be perfectly flat. For example, a nap thickness of the base layer 116 may be between about 0.1 mm and about 5 mm. The surface of the base layer 116 is then polished to be flat in preparation for the formation of the top layer 118A. A thickness T of the base layer 116 (e.g., after being polished) may be between about 10 mm and about 100 mm, as an example.

The top layer 118A is formed over the base layer 116 by a suitable formation method, such as physical vapor deposition (PVD), chemical vapor deposition (CVD), spin coating, or the like, and may have a thickness T1 between about 10 mm and 100 mm. Different regions (e.g., polishing zones) of the top layer 118A may be formed of different materials and have different surface properties, as discussed below. In some embodiments, after a new polishing pad is installed on the CMP tool, the polishing pad goes through a break-in period where a dressing disk sweeps (e.g., scrapes) the surface of the top layer (e.g., 118A) of the new polishing pad to expose pores inside the polishing pad, which pores may help to store the slurry used during the CMP process. If the thickness T1 of the top layer is larger than about 100 mm, the break-in period may be difficult (e.g., longer) due to the dressing process. If the thickness T1 is smaller than about 10 mm, the pad life may be negatively affected (e.g., shortened) and there may be concerns regarding excessive wear-and-tear of the polishing pad.

As illustrated in FIGS. 4A and 4B, the top layer 118A includes a plurality of polishing zones, such as polishing zones 411, 413, 415, and 417. The polishing zone 411 is a circular region at the center of the top layer 118A. FIG. 4B shows the polishing zone 411 disposed around the center axis 115AX of the polishing pad 115A. The polishing zones 413, 415, and 417 are annular shaped regions that are formed around the polishing zone 411. In other words, the polishing zones 411, 413, 415, and 417 are concentric, as illustrated in FIG. 4A. Note that four polishing zones are illustrated in FIGS. 4A and 4B as a non-limiting example. Other numbers of polishing zones, such as two, three, or more than four polishing zones may be formed in the top layer 118A, as one skilled in the art readily appreciates. In some embodiments, the number of polishing zones of the polishing pad 115A is between 2 and 15.

In the example of FIGS. 4A and 4B, each of the polishing zones 411, 413, 415, and 417 is formed of a different material, such that the surface property (e.g., hardness, roughness, coefficient of friction, or the like) of a polishing zone is different from the other polishing zones. In some embodiments, the top layer 118A of the polishing pad 115A has at least a first polishing zone and a second polishing zone, where the first polishing zone is formed of an organic material, and the second polishing zone is formed of an inorganic material. The organic material may be polyvinyl alcohol, polyvinyl pyrrolidone, polyethylene, methylcellulose, hydropropylmethylcellulose, hydroxyethylcellulose, carboxymethylcellulose maleic acid copolymer, polyacrylic acid, polyurethane, or the like, as examples. The molecular weight of the organic material is between about 1000 g/mol and about 1000000 g/mol, such as between about 100000 g/mol and about 1000000 g/mol, in some embodiments. The inorganic material may be titanium oxide (e.g., $TiO_2$), silicon oxide (e.g., $SiO_2$), aluminum oxide (e.g., $Al_2O_3$), copper oxide (e.g., CuO), zinc peroxide (e.g., $ZnO_2$), zirconium dioxide (e.g., $ZrO_2$), platinum (e.g., Pt), gold (e.g., Au), or calcium titanate (e.g., $CaTiO_3$), as examples.

In some embodiments, the size of the particles of the inorganic material (also referred to as inorganic material particles) is smaller than about 100 nm, such as between about 1 nm and about 100 nm. Since inorganic materials are generally harder than organic materials, the size of the inorganic material particles is chosen to avoid or reduce the possibility of scratching the wafer when the inorganic material particles come off (e.g., due to the wear and tear of the polishing pad) the polishing pad 115A during the CMP operation. Inorganic material particles with sizes smaller than about 100 nm may have significantly reduced chance of scratching the wafer surface.

In some embodiments, the top layer 118A of the polishing pad 115A has additional polishing zone(s) besides the first polishing zone (e.g., formed of an organic material) and the second polishing zone (e.g. formed of an inorganic material), in which case each of the additional polishing zone(s) may be formed of an organic material or an inorganic material. In some embodiments, each of the polishing zones of the top layer 118A is formed of a different material, such as an organic or an inorganic material listed above. In some embodiments, the polishing pad 115A has a plurality of polishing zones, where at least a first polishing zone is formed of an organic material, a second polishing zone is formed of an inorganic material, and at least two of the polishing zones are formed of a same material (e.g., a same organic or inorganic material).

The number of polishing zones of the polishing pad 115A and the materials of the polishing zones may have any suitable combinations to form polishing pads with a plurality of polishing zones with different surface properties. For example, polishing zones near the center of the polishing pad 115A, such as the polishing zone 411, may be formed of organic materials (e.g., with higher friction coefficient), and polishing zones near the edge of the polishing pad 115A, such as the polishing zone 417, may be formed of inorganic materials (e.g., with lower friction coefficient). In an example embodiment, the polishing pad 115A has two polishing zones, where the center polishing zone (e.g., a circular region) is formed of an organic material, and the outer polishing zone (e.g., an annular region around the center polishing zone) is formed of an inorganic material. In another embodiment, the polishing pad 115A has more than two polishing zones, with the material chose for each of the polishing zones such that the friction coefficient decreases along a radial direction of the polishing pad from the center of the polishing pad to the edge of the polishing pad. In yet another embodiment, the polishing pad 115A has three or more polishing zones, with the materials chosen for each of the polishing zones such that the friction coefficient decreases and increases alternately along a radial direction from the center of the polishing pad to the edge of the polishing pad. This may be achieved, e.g., by using organic material and inorganic material alternately in the polishing zones.

As described above, the polishing pad 115A has multiple polishing zones, with each of the polishing zone formed of an organic material or an inorganic material. Therefore, the polishing pad 115A is also referred to as a hybrid-composite material pad (HCMP). The polishing zones of the polishing pads 115A have different surface properties, which allow the wafer to be moved to different regions of the polishing pad 115A during the CMP process to achieve different polishing characteristics (e.g., different load, different friction coefficient, or different etch rate) for different regions of the wafer to compensate for the loading effect of the wafer.

For example, a large load force measured by a sensor 129 may indicate that the corresponding region of the wafer has a high pattern density and a slow removal rate. If the measurements of the sensors 129 indicate a larger load difference in different regions of the wafer 300, for example, when the difference (e.g., a maximum load difference) between the load forces in different regions of the wafer exceeds a pre-determined threshold, a controller of the CMP tool may move the carrier 125 (and the wafer) to a different location over the polishing pad 115, such that a region of the wafer having a high load force measurement is moved to a polishing zone with a high removal rate (e.g., high friction coefficient, or higher surface roughness) to reduce the unevenness of the wafer and to reduce the load difference. As another example, if the load force in a first region of the wafer exceeds a pre-determined threshold, the controller of the CMP tool may move the wafer to a different location over the polishing pad, such that the first region of the wafer is polished by a polishing zone with a high removal rate and to reduce the load force in the first region.

In some embodiments, to facilitate polishing a particular region of the wafer using a particular polishing zone of the polishing pad, the rotation of the carrier 125 may be stopped temporarily for a period of time during the CMP process while the polishing pad 115 rotates. For example, when the load force in a region of the wafer exceeds a pre-determined threshold, or when the load difference between different regions of the wafer exceeds a pre-determined threshold, the rotation of the carrier 125 may be stopped temporarily, and the carrier 125 is moved to a different location (as described above) such that different regions of the wafer are polished using different polishing zones, until the load force or the load difference falls below the pre-determined threshold, at which point the carrier 125 may start rotating again.

Figure 5B:
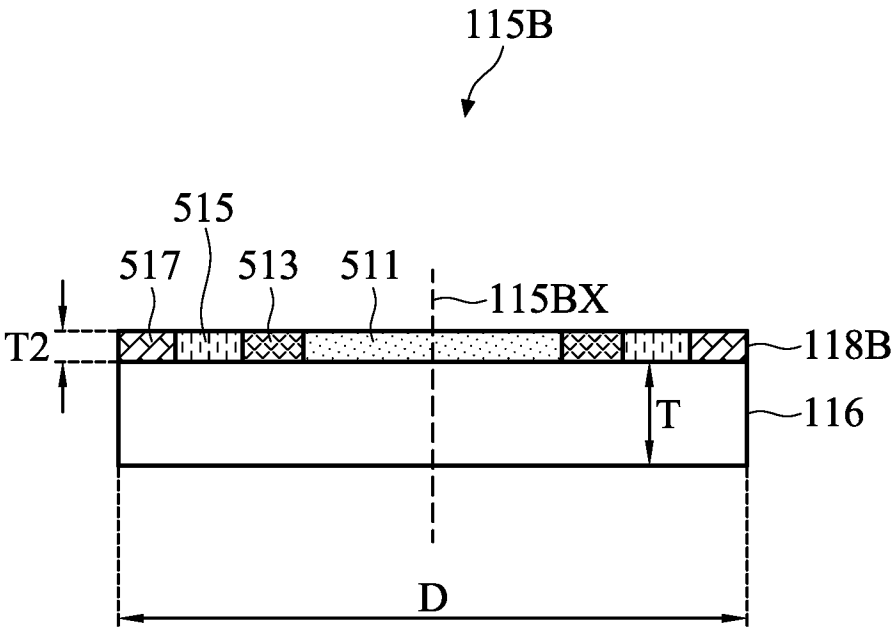
FIGS. 5A and 5B illustrate a top view and a cross-sectional view, respectively, of a polishing pad, in accordance with an embodiment.
Figure 5A:
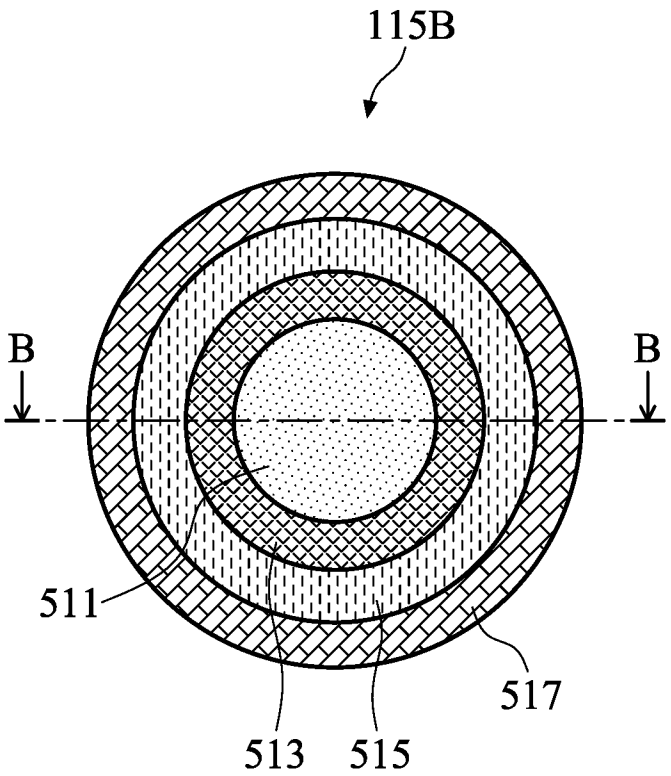

FIGS. 5A and 5B illustrate a top view and a cross-sectional view, respectively, of a polishing pad 115B, in accordance with an embodiment. FIG. 5B is the cross-sectional view of FIG. 5A along cross-section B-B. The polishing pad 115B may be used as the polishing pad 115 in FIGS. 1-3.

In the example of FIGS. 5A and 5B, the polishing pad 115B has a base layer 116 and a top layer 118B. The diameter D of the polishing pad 115B, the thickness T of the base layer 116, and the material of the base layer 116 may be the same as or similar to those of the polishing pad 115A, thus are not repeated. A thickness T2 of the top layer 118B is between about 10 mm and about 100 mm.

Referring to FIGS. 5A and 5B, the top layer 118B has a plurality of polishing zones, such as polishing zones 511, 513, 515, and 517. The polishing zone 511 at the center of the top layer 118B has a circular shape (e.g., around the center axis 115BX of the polishing pad 115B), and the polishing zones 513, 515, and 517 have annular shapes and are concentric with the polishing zone 511. Note that four polishing zones are illustrated in FIGS. 5A and 5B as a non-limiting example. Other numbers of polishing zones, such as two, three, or more than four polishing zones may be formed in the top layer 118B, as one skilled in the art readily appreciates. In some embodiments, the number of polishing zones of the polishing pad 115B is between 2 and 15.

In the illustrated embodiment, the different polishing zones of the top layer 118B are formed of a same material, but have different groove patterns in the polishing zones. Therefore, the polishing pad 115B may also be referred to as a hybrid-pattern groove pad (HPGP). Examples of the groove patterns are illustrated in FIGS. 6A-6G, as discussed in more details hereinafter.

In some embodiments, the material of the top layer 118B is an organic material, such as polyvinyl alcohol, polyvinyl pyrrolidone, polyethylene, methylcellulose, hydropropylmethylcellulose, hydroxyethylcellulose, carboxymethylcellulose maleic acid copolymer, polyurethane, or the like. The molecular weight of the organic material is between about 1000 g/mol and about 1000000 g/mol, such as between about 100000 g/mol and about 1000000 g/mol, in some embodiments. In some embodiments, the material of the top layer 118B is an inorganic material, such as titanium oxide (e.g., $TiO_2$), silicon oxide (e.g., $SiO_2$), aluminum oxide (e.g., $Al_2O_3$), copper oxide (e.g., CuO), zinc peroxide (e.g., $ZnO_2$), zirconium dioxide (e.g., $ZrO_2$), platinum (e.g., Pt), gold (e.g., Au), or calcium titanate (e.g., $CaTiO_3$). The inorganic material particles have a size smaller than about 100 nm, in some embodiments.

In the illustrated embodiment, each of the polishing zones of the polishing pad 115B has a different groove pattern, thereby providing different surface properties in different polishing zones. For example, the different groove patterns provide different coefficients of friction for each polishing zone. In addition, the groove patterns may be designed to produce different slurry flow patterns in different polishing zones. For a conventional polishing pad having a homogenous surface property, it may be difficult to achieve a substantially uniform slurry flow field (e.g., flow pattern of the slurry) over the polishing pad, e.g., due to the loading effect of the wafer. The presently disclosed polishing pad 115B, with different groove patterns, allows the slurry flow field to be fine-tuned using the different groove patterns in different polishing zones, thereby achieving a substantially uniform slurry flow field and improved evenness of the polished wafer surface.

In an embodiment, the CMP tool measures the slurry flow field over the upper surface of the polishing pad 115B, e.g., using an imaging device. Based on the measured slurry field, a controller of the CMP tool may move the slurry dispenser 140 (see FIG. 2) from a first location to a second location over a particular polishing zone. As the slurry is dispensed into the particular polishing zone, the groove pattern of the particular polishing zone may change the slurry flow field in certain ways to compensate for, e.g., the loading effect of the wafer, thereby resulting in a substantially uniform slurry flow field over the polishing pad.

FIGS. 6A-6F illustrate top views of various groove patterns for the polishing pad 115B illustrated in FIGS. 5A and 5B, in some embodiments. FIG. 6G illustrates a perspective view of a groove pattern for the polishing pad 115B, in an embodiment. Each of the polishing zones of the polishing pad 115B may have a different groove pattern, such as one of the groove patterns illustrated in FIGS. 6A-6G. Although FIG. 5A shows a different groove pattern in each of the polishing zones, some (but not all) of the polishing zones of the polishing pads 115B may have a same groove pattern, these and other variations are fully intended to be included within the scope of the present disclosure. The groove patterns may be formed by patterning the material (e.g., an inorganic material, or an organic material) of the top layer 118B. Any suitable patterning methods, such as photolithography and etching, molding (e.g., using a mold), or the like, may be used.

Figure 6A:
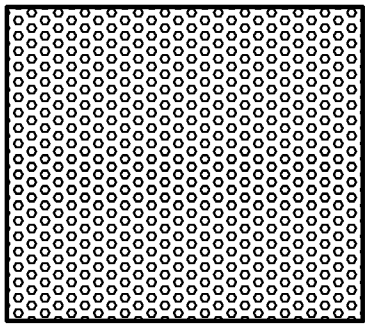
FIGS. 6A-6G illustrate various groove patterns for the polishing pad illustrated in FIGS. 5A and 5B, in some embodiments.
Figure 6B:
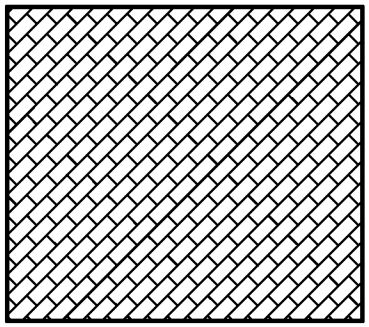
Figure 6C:
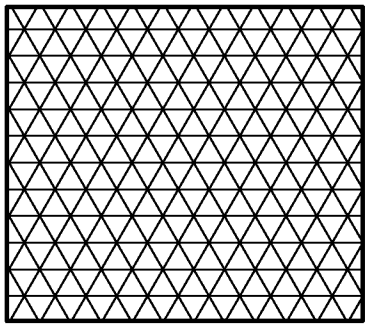
Figure 6D:
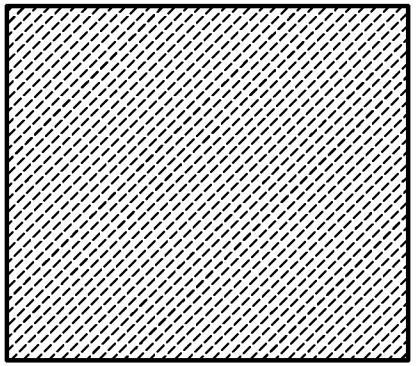
Figure 6E:
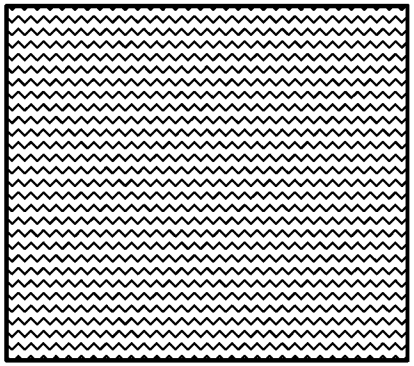
Figure 6F:
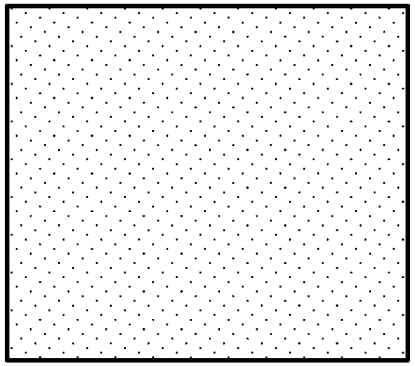
Figure 6G:
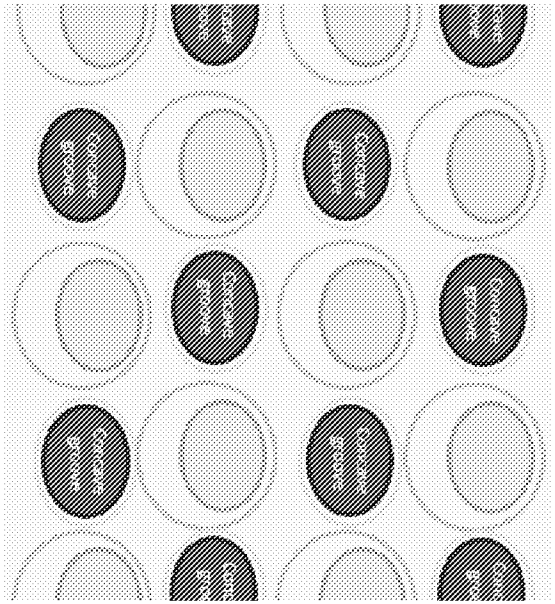

FIG. 6A illustrates an example where the groove pattern includes circular shaped structures that are hollow in the middle. The groove patterns of FIGS. 6B and 6C include polygon shaped structures and triangle shaped structures, respectively. The groove pattern of FIG. 6D includes line shaped structures, where a longitudinal direction of the line shaped structures is along a radial direction of the polishing pad or along a tangent direction (e.g., tangent to the radial direction) of the polishing pad. The groove pattern of FIG. 6E includes wavy line shaped structures, and the groove pattern of FIG. 6F includes dot shaped structures. FIG. 6G illustrates an example where the groove pattern includes pillar shaped structures spaced apart by holes in the top layer 118A.

Figure 7B:
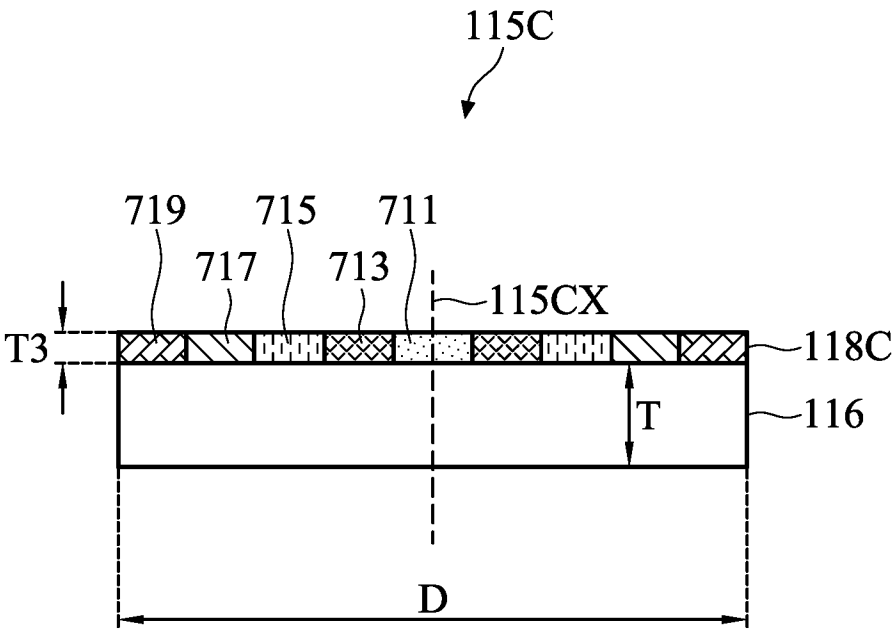
FIGS. 7A and 7B illustrate a top view and a cross-sectional view, respectively, of a polishing pad, in accordance with an embodiment.
Figure 7A:
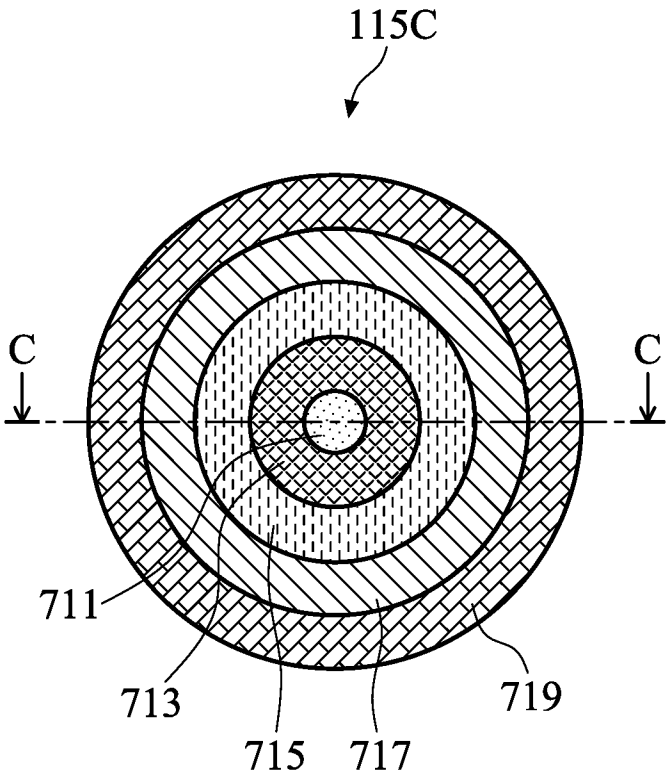

FIGS. 7A and 7B illustrate a top view and a cross-sectional view, respectively, of a polishing pad 115C, in accordance with an embodiment. FIG. 7B is the cross-sectional view of FIG. 7A along cross-section C-C. The polishing pad 115C may be used as the polishing pad 115 in FIGS. 1-3.

In the example of FIGS. 7A and 7B, the polishing pad 115C has a base layer 116 and a top layer 118C. The diameter D of the polishing pad 115C, the thickness T of the base layer 116, and the material of the base layer 116 may be the same as or similar to those of the polishing pad 115A, thus are not repeated. A thickness T3 of the top layer 118C is between about 10 mm and about 100 nm. Similar to the embodiment of FIGS. 4A and 4B, a nap thickness of base layer 116 may be between about 0.1 mm and about 5 mm.

Referring to FIGS. 7A and 7B, the top layer 118C has a plurality of polishing zones, such as polishing zones 711, 713, 715, 717, and 719. The polishing zone 711 is at the center of the top layer 118C with a circular shape (e.g., around the center axis 115CX of the polishing pad 115C), and the polishing zones 713, 715, 717, and 719 have annular shapes and are concentric with the polishing zone 711. Note that five polishing zones are illustrated in FIGS. 7A and 7B as a non-limiting example. Other numbers of polishing zones, such as more or less than five polishing zones may be formed in the top layer 118C, as one skilled in the art readily appreciates. In some embodiments, the number of polishing zones of the polishing pad 115C is between 2 and 15.

In an embodiment, the different polishing zones of the polishing pad 115C are formed using a mixture of an organic material and an inorganic material, where the mixing ratio between the organic material and the inorganic material (e.g., a volume ratio between the organic material and the inorganic material) in each polishing zone is changed gradually along a radial direction of the polishing pad 115C, such that the friction coefficient of the top layer 118C has a gradient along the radial direction. Therefore, the polishing pad 115C is also referred to as a gradient friction material pad (GFMP). In other words, each of the polishing zones 711, 713, 715, 717, and 719 has a respective mixing ratio for the mixture of the organic material and the inorganic material, and the mixing ratios change (e.g., decrease) along the radial direction from the center of the polishing pad 115C to the edge of the polishing pad 115C.

In an example embodiment, the mixture used for forming the top layer 118C of the polishing pad 115C includes an organic material A and an inorganic material B. The polishing zone 711 is formed of the organic material A only (a mixture comprising 100% organic material A and 0% inorganic material B), the polishing zones 713 is formed of a mixture comprising, e.g., 75% organic material A and 25% inorganic material B, the polishing zones 715 is formed of a mixture comprising, e.g., 50% organic material A and 50% inorganic material B, the polishing zones 717 is formed of a mixture comprising, e.g., 25% organic material A and 75% inorganic material B, and the polishing zones 719 is formed of the inorganic material B only (e.g., 0% organic material A and 100% inorganic material B). Since organic material may have higher friction coefficient than inorganic material, the friction coefficients of the polishing zones of the polishing pad in the above example forms a gradient that decrease along the radial direction from the center of the polishing pad to the edge of the polishing pad. The mixing ratio used in the above example is merely a non-limiting example, other mixing ratio are also possible and are fully intended to be included within the scope of the present disclosure. As another example, a polishing pad with a friction coefficient gradient that increases along the radial direction from the center of the polishing pad to the edge of the polishing pad is also contemplated within the scope of the present disclosure.

The organic material used in the mixture to form the polishing zones of the polishing pad 115C may be polyvinyl alcohol, polyvinyl pyrrolidone, polyethylene, methylcellulose, hydropropylmethylcellulose, hydroxyethylcellulose, carboxymethylcellulose maleic acid copolymer, polyurethane, polyacrylamide, or the like. The molecular weight of the organic material is between about 1000 g/mol and about 1000000 g/mol, such as between about 100000 g/mol and about 1000000 g/mol, in some embodiments. The inorganic material used in the mixture may be titanium oxide (e.g., $TiO_2$), silicon oxide (e.g., $SiO_2$), aluminum oxide (e.g., $Al_2O_3$), copper oxide (e.g., CuO), zinc peroxide (e.g., $ZnO_2$), zirconium dioxide (e.g., $ZrO_2$), platinum (e.g., Pt), gold (e.g., Au), or calcium titanate (e.g., $CaTiO_3$). The inorganic material particles have a size smaller than about 100 nm, in some embodiments.

In another embodiment, the different polishing zones of the polishing pad 115C may be formed using a polymer material only, but the molecular weight of the polymer material is changed (e.g., decreased) in each of the polishing zone along the radial direction from the center of the polishing pad to the edge of the polishing pad. Since a polymer material with a large molecular weight may have a higher friction coefficient, the polishing pad formed in this example also exhibits a gradient in the friction coefficient along the radial direction of the polishing pad 115C.

Operation of the CMP tool with the polishing pad 115C may be the same as or similar to the CMP tool with the polishing pad 115A, thus details may not be repeated. In some embodiments, based on the measured load conditions, the controller of the CMP tool may move the carrier 125 from a first location to a second location over the polishing pad 115C, such that different regions of the wafer 300 may be polished by different polishing zones to reduce the unevenness of the wafer surface and to reduce the load difference.

Variations to the disclosed embodiments are possible and are fully intended to be included within the scope of the present disclosure. For example, the embodiment of FIGS. 5A and 5B may be combined with the embodiment of FIGS. 4A and 4B (or FIGS. 7A and 7B) to form a polishing pad where each polishing zone has a different groove pattern and is formed of a different material.

Embodiment may achieve advantages. Each of the disclosed polishing pads has multiple polishing zones, and the surface property of each of the polishing zones may be tuned independently. For example, the material and/or the groove pattern in each polishing zone may be designed independently of other polishing zone. This allows the polishing pad to be designed and fine-tuned to achieve various polishing characteristics. The CMP process may be modified to take advantage of the multiple surface properties provided by the multiple polishing zones, such as moving the carrier and/or moving the slurry dispenser based on measured load conditions and/or slurry flow field. As a result, a more evenly distributed load condition and/or a substantially uniform slurry flow field may be achieved, which in turn improves evenness of the wafer surface after the CMP process. Another advantage is the improved life span of the polishing pad compared to a conventional polishing pad with one polishing zone or one groove pattern. To overcome the loading effect and achieve improved evenness of the wafer surface, a CMP tool using the conventional polishing pad may have to increase the load force on the wafer, which increases the wear and tear of the polishing pad. In contrast, the presently disclosed polishing pads achieve a more balanced load condition and improved evenness of the wafer surface without the need to increase the load force, thereby prolonging the life span of the polishing pad and save manufacturing cost.

Figure 8:
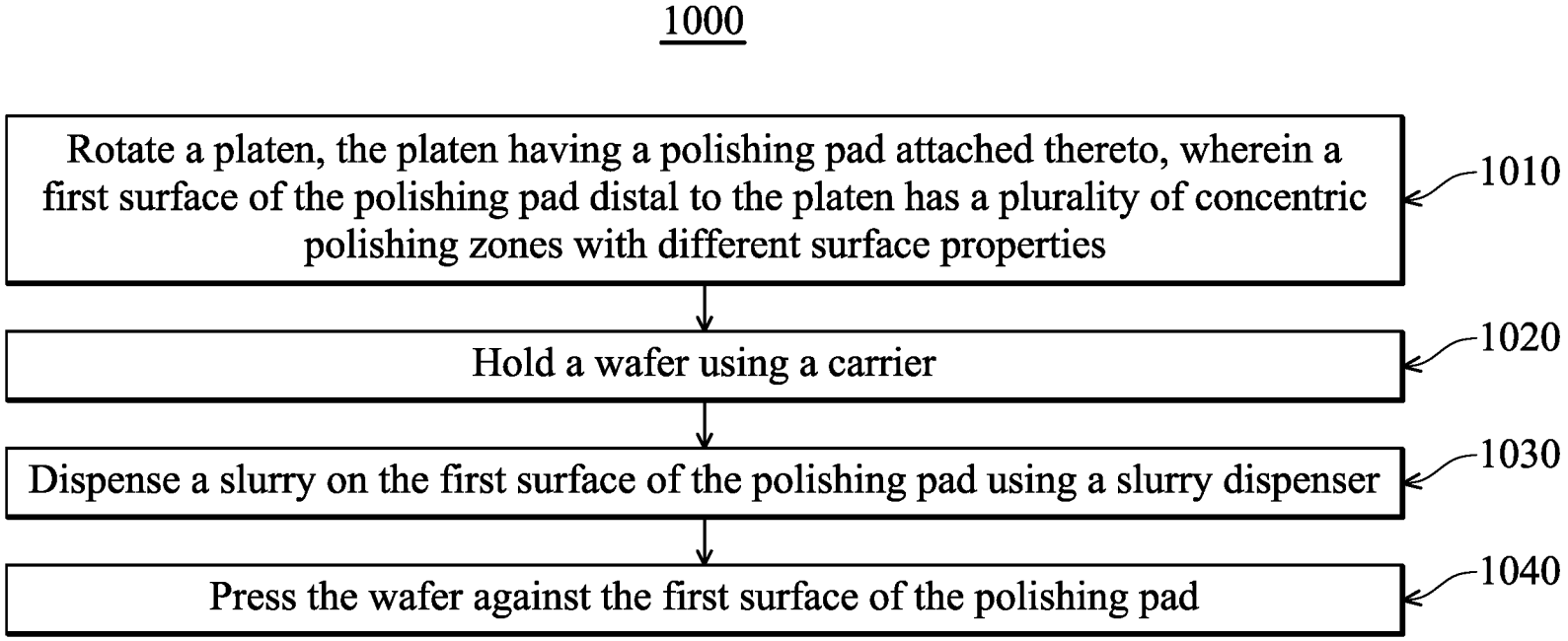
FIG. 8 illustrates a flow chart of a method of operating a CMP tool, in accordance with some embodiments.

FIG. 8 illustrates a flow chart of a method of operating a CMP tool, in accordance with some embodiments. It should be understood that the embodiment method shown in FIG. 8 is merely an example of many possible embodiment methods. One of ordinary skill in the art would recognize many variations, alternatives, and modifications. For example, various steps as illustrated in FIG. 8 may be added, removed, replaced, rearranged and repeated.

Referring to FIG. 8, at step 1010, a platen is rotated, the platen having a polishing pad attached thereto, wherein a first surface of the polishing pad distal to the platen has a plurality of concentric polishing zones with different surface properties. At step 1020, a wafer is held using a carrier. At step 1030, a slurry is dispensed on the first surface of the polishing pad using a slurry dispenser. At step 1040, the wafer is pressed against the first surface of the polishing pad.

In accordance with an embodiment, a chemical mechanical planarization (CMP) tool includes a platen; and a polishing pad attached to the platen, wherein a first surface of the polishing pad facing away from the platen comprises a first polishing zone and a second polishing zone, wherein the first polishing zone is a circular region at a center of the first surface of the polishing pad, and the second polishing zone is an annular region around the first polishing zone, wherein the first polishing zone and the second polishing zone have different surface properties. In an embodiment, the first polishing zone and the second polishing zone comprise different materials or have different groove patterns. In an embodiment, the first polishing zone comprises an organic material, and the second polishing zone comprises an inorganic material. In an embodiment, the organic material is polyvinyl alcohol, polyvinyl pyrrolidone, polyethylene, methylcellulose, hydropropylmethylcellulose, hydroxyethylcellulose, carboxymethylcellulose maleic acid copolymer, or polyurethane. In an embodiment, the inorganic material is titanium oxide, silicon oxide, aluminum oxide, copper oxide, zinc peroxide, zirconium dioxide, platinum, gold, or calcium titanate. In an embodiment, the first polishing zone comprises a first mixture of an organic material and an inorganic material, and the second polishing zone comprises a second mixture of the organic material and the inorganic material, wherein the first mixture has a first mixing ratio between the organic material and the inorganic material, the second mixture has a second mixing ratio between the organic material and the inorganic material, the second mixing ratio being different from the first mixing ratio. In an embodiment, the first mixing ratio is larger than the second mixing ratio. In an embodiment, the first polishing zone and the second polishing zone comprise a same material but have different groove patterns. In an embodiment, the first polishing zone and the second polishing zone comprise different materials and have different groove patterns. In an embodiment, the first polishing zone comprises a polymer material with a first molecular weight, and the second polishing zone comprise the polymer material with a second molecular weight different from the first molecular weight. In an embodiment, the first molecular weight is larger than the second molecular weight.

In accordance with an embodiment, a chemical mechanical planarization (CMP) tool includes a carrier configured to hold a wafer; a platen; a slurry dispenser; and a polishing pad attached to the platen, wherein a first surface of the polishing pad facing the carrier has a plurality of concentric polishing zones, each of the plurality of concentric polishing zones having a different surface property. In an embodiment, the plurality of concentric polishing zones comprises: a first polishing zone at a center of the first surface of the polishing pad and having a circular shape; and a second polishing zone around the first polishing zone and having an annular shape. In an embodiment, a first material of the first polishing zone is an organic material. In an embodiment, a second material of the second polishing zone is an inorganic material. In an embodiment, the plurality of concentric polishing zones further comprises a third polishing zone between the first polishing zone and the second polishing zone, the third polishing zone having an annular shape, wherein a third material of the third polishing zone is a mixture of the organic material and the inorganic material. In an embodiment, the first polishing zone and the second polishing zone have different groove patterns.

In accordance with an embodiment, a method of operating a chemical mechanical planarization (CMP) tool includes rotating a platen, the platen having a polishing pad attached thereto, wherein a first surface of the polishing pad distal to the platen has a plurality of concentric polishing zones with different surface properties; holding a wafer using a carrier; dispensing a slurry on the first surface of the polishing pad using a slurry dispenser; and pressing the wafer against the first surface of the polishing pad. In an embodiment, the method further comprises monitoring load forces exerted in different regions of the wafer; detecting that a difference between the load forces in the different regions of the wafer exceeds a pre-determined value; and in response to the detecting, moving the wafer from a first location of the first surface of the polishing pad to a second location of the first surface of the polishing pad to reduce the difference between the load forces. In an embodiment, the method further comprises measuring a flow field of the slurry on the first surface of the polishing pad; and moving the slurry dispenser from a first location over the polishing pad to a different second location over the polishing pad in accordance with the measured flow field of the slurry, wherein moving the slurry dispenser increases uniformity of the flow field.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A chemical mechanical planarization (CMP) tool comprising:

a platen; and a polishing pad attached to the platen, wherein a first surface of the polishing pad facing away from the platen comprises a first polishing zone and a second polishing zone, wherein the first polishing zone and the second polishing zone are concentric polishing zones around a center of the polishing pad, wherein the first polishing zone and the second polishing zone comprise different materials and have different groove patterns.

2. The CMP tool of claim 1, wherein the first polishing zone is a circular region at a center of the first surface of the polishing pad, and the second polishing zone is an annular region around the circular region.

3. The CMP tool of claim 1, wherein the first polishing zone is a first annular region around a center of the first surface of the polishing pad, and the second polishing zone is a second annular region around the first annular region.

4. The CMP tool of claim 1, wherein the first polishing zone comprises a first mixture of an organic material and an inorganic material, and the second polishing zone comprises a second mixture of the organic material and the inorganic material, wherein a first mixing ratio between the organic material and the inorganic material in the first polishing zone is different from a second mixing ratio between the organic material and the inorganic material in the second polishing zone.

5. The CMP tool of claim 4, wherein the first mixing ratio is larger than the second mixing ratio.

6. The CMP tool of claim 4, wherein the first surface of the polishing pad further comprises a third polishing zone between the first polishing zone and the second polishing zone, wherein the third polishing zone comprises a third mixture of the organic material and the inorganic material, wherein the third mixture has a third mixing ratio between the organic material and the inorganic material, wherein the third mixing ratio is smaller than the first mixing ratio and larger than the second mixing ratio.

7. The CMP tool of claim 1, wherein the first surface of the polishing pad comprises a plurality of polishing zones that includes the first polishing zone and the second polishing zone, wherein at least two of the plurality of polishing zones comprise a same material.

8. The CMP tool of claim 1, wherein the first polishing zone comprises a polymer material with a first molecular weight, and the second polishing zone comprises the polymer material with a second molecular weight different from the first molecular weight.

9. The CMP tool of claim 8, wherein the first molecular weight is larger than the second molecular weight.

10. The CMP tool of claim 1, wherein the first polishing zone comprises an organic material, and the second polishing zone comprises an inorganic material.

11. The CMP tool of claim 10, wherein the organic material is polyvinyl alcohol, polyvinyl pyrrolidone, polyethylene, methylcellulose, hydropropylmethylcellulose, hydroxyethylcellulose, carboxymethylcellulose maleic acid copolymer, or polyurethane, wherein the inorganic material is titanium oxide, silicon oxide, aluminum oxide, copper oxide, zinc peroxide, zirconium dioxide, platinum, gold, or calcium titanate.

12. A chemical mechanical planarization (CMP) tool comprising:

a carrier configured to hold a wafer;

sensors attached to the carrier;

a platen;

a polishing pad attached to the platen, wherein a first surface of the polishing pad facing the carrier has a plurality of concentric polishing zones, wherein each of the plurality of concentric polishing zones has a different surface property, wherein the sensors are configured to measure load forces exerted in different regions of the wafer when the carrier presses the wafer against the polishing pad; and a controller, wherein the controller is configured to:

monitor the load forces exerted in the different regions of the wafer;

detect that a difference between the load forces in the different regions of the wafer exceeds a pre-determined value; and in response to the detecting, move the carrier from a first location of the first surface of the polishing pad to a second location of the first surface of the polishing pad to reduce the difference between the load forces.

13. The CMP tool of claim 12, wherein the plurality of concentric polishing zones comprises:

a first polishing zone at a center of the first surface of the polishing pad; and a second polishing zone around the first polishing zone.

14. The CMP tool of claim 13, wherein a first material of the first polishing zone is an organic material, wherein a second material of the second polishing zone is an inorganic material.

15. The CMP tool of claim 14, wherein the plurality of concentric polishing zones further comprises a third polishing zone between the first polishing zone and the second polishing zone, wherein a third material of the third polishing zone is a mixture of the organic material and the inorganic material.

16. The CMP tool of claim 12, wherein the plurality of concentric polishing zones comprise different materials and have different groove patterns.

17. A method of operating a chemical mechanical planarization (CMP) tool, the method comprising:

rotating a platen, the platen having a polishing pad attached thereto, wherein a first surface of the polishing pad distal to the platen has a plurality of concentric polishing zones with different surface properties;

holding a wafer using a carrier;

dispensing a slurry on the first surface of the polishing pad using a slurry dispenser;

pressing the wafer against the first surface of the polishing pad;

measuring a flow pattern of the slurry on the first surface of the polishing pad using an imaging device; and moving the slurry dispenser from a first location over the polishing pad to a different second location over the polishing pad in accordance with the measured flow pattern of the slurry, wherein moving the slurry dispenser increases uniformity of the flow pattern of the slurry.

18. The method of claim 17, further comprising:

monitoring load forces exerted in different regions of the wafer;

detecting that a difference between the load forces in the different regions of the wafer exceeds a pre-determined value; and in response to the detecting, moving the wafer from a third location of the first surface of the polishing pad to a fourth location of the first surface of the polishing pad to reduce the difference between the load forces.

19. The method of claim 18, wherein monitoring load forces comprises measuring the load forces using pressure sensors attached to the carrier.

20. The method of claim 17, wherein the plurality of concentric polishing zones comprise a first polishing zone and a second polishing zone around the first polishing zone, wherein the first polishing zone and the second polishing zone comprise different materials and have different groove patterns.

* * * * *